US012035762B2

(12) United States Patent
Dickson

(10) Patent No.: US 12,035,762 B2
(45) Date of Patent: Jul. 16, 2024

(54) ENHANCED MEDICAL WEAR WITH BUILT-IN EQUIPMENT RETAINMENT FEATURES

(71) Applicant: OliveUs Apparel LLC, La Jolla, CA (US)

(72) Inventor: Kathryn Dickson, La Jolla, CA (US)

(73) Assignee: OliveUs Apparel LLC, La Jolla, CA (US)

( * ) Notice: Subject to any disclaimer, the term of this patent is extended or adjusted under 35 U.S.C. 154(b) by 10 days.

(21) Appl. No.: 16/901,777

(22) Filed: Jun. 15, 2020

(65) Prior Publication Data

US 2021/0386128 A1 Dec. 16, 2021

(51) Int. Cl.
*A41F 9/02* (2006.01)
*A41D 1/06* (2006.01)

(52) U.S. Cl.
CPC . *A41D 1/06* (2013.01); *A41F 9/02* (2013.01)

(58) Field of Classification Search
CPC .. A41D 1/06; A41D 13/0012; A41D 13/1209; A41D 13/1281; A41F 9/02
USPC ..... 2/79
See application file for complete search history.

(56) References Cited

U.S. PATENT DOCUMENTS 1,105,282 A * 7/1914 Leibel ..... A41F 9/025 2/237
1,421,514 A * 7/1922 Mcfarland ..... A41F 9/025 24/702
1,469,682 A * 10/1923 North ..... A41F 9/025 24/301
2,233,136 A * 2/1941 Larson ..... A41F 9/025 2/237
3,638,242 A * 2/1972 Herter ..... A41F 9/02 2/237
6,041,441 A * 3/2000 Counts ..... A41D 13/0575 450/150
9,078,476 B2 * 7/2015 Haueter ..... A41D 1/08
10,455,877 B2 * 10/2019 Moore ..... A41F 9/025
2007/0028349 A1 * 2/2007 Watson ..... A41D 1/06 2/69
2014/0115755 A1 * 5/2014 Mahar ..... A41F 9/025 2/336
2014/0182044 A1 * 7/2014 Cole ..... A41D 1/089 2/69
2016/0100642 A1 * 4/2016 Swan ..... A45F 5/021 224/191
2020/0138136 A1 * 5/2020 Harris ..... A41D 1/089

FOREIGN PATENT DOCUMENTS

DE 102017200540 A1 * 7/2018
JP 2008150762 A * 7/2008

* cited by examiner

*Primary Examiner* — Tajash D Patel
(74) *Attorney, Agent, or Firm* — Lee & Hayes, P.C.

(57) ABSTRACT

A pair of scrub pants is provided having a built-in retainment feature. The pair of scrub pants comprises two pant legs extending downward from a bottom side of a hip region and a waistband disposed on the top side of the hip region. One or more instrument retainment features disposed on the waistband are accessible to the user. The one or more instrument retainment features have a first position where one or more instrument retainment features rest flat against the waistband. The instrument retainment features can comprise one or more of elastic bands, hooks, snap fasteners, among others.

13 Claims, 10 Drawing Sheets

ENHANCED MEDICAL WEAR WITH BUILT-IN EQUIPMENT RETAINMENT FEATURES

DESCRIPTION OF RELATED ART

Medical scrubs were originally designed for use by surgeons and other medical personnel during operations in the operating room. Over time, the use of scrubs has increased throughout the hospital. Part of the reason for the proliferation of scrubs use throughout the hospital is the simple design without many embellishments, making scrubs easy to launder and cheap to replace if damages or stained irreparably.

The purpose of scrubs was to provide a simple design for clothing that can cover the individuals in the operating room to protect an individual's clothes not only from stains but also to reduce the places where contaminants to hide. Conventional scrubs (both scrub tops and scrub pants) include minimal features. Scrub pants are traditionally secured along the waistline by a draw string or elastic band. One or more pockets may be disposed on either or both legs.

SUMMARY

Various embodiments of the technology disclosed herein provides scrub pants with a built-in instrument retainment feature. In various embodiments, the scrub pants comprise two pant legs extending downward from a bottom side of a hip region; a waistband disposed on a top side of the hip region; a draw string disposed on the waistband; and one or more instrument retainment features disposed on the waistband, the one or more instrument retainment features accessible to a user, wherein the instrument retainment feature has a first position where the one or more instrument retainment features rest flat against the waistband.

In various embodiment, the one or more instrument features comprises one or more elastic bands, wherein each of the one or more elastic bands are separate components. Each of the one or more elastic bands in various embodiments comprises a first end and a second end, each of the first end and the second end being attached to the waistband. In various embodiments, the first end and the second end of each of the one or more elastic bands are attached to an interior surface of the waistband. In some embodiments, the elastic band is woven into the waistband such that the first end enters the waistband through a first opening, the second end enters the waistband through a second opening, and the elastic band comprises a middle portion that is between the first opening and the second opening.

In other embodiments, the first end and the second end of each of the one or more elastic bands can be attached to an exterior surface of the waistband.

Attaching the first end and the second end to the interior and/or exterior of the waistband comprises one or more of sewn, glued, stapled, riveted, or heat sealed in various embodiments.

In various embodiments, the one or more elastic bands are portions of the same elastic band. In some embodiments, each of the portions of the same elastic band are associated with a region of the waistband, the region of the waistband enabling access to the portion of the same elastic band. In various embodiments, each of the regions of the waistband can include one or more attachment points to secure the portion of the same elastic band within the region of the waistband. The first end of the portion of the same elastic band within each region is attached to a first attachment point of each region and a second end of the portion of the same elastic band within each region is attached to a second attachment point of each region in various embodiments.

In various embodiments, the one or more instrument retainment features comprises one or more of elastic bands, hooks, snap fasteners, buckles, or a combination thereof.

In various embodiments, the one or more instrument retainment features and the draw string are disposed in an interior of the waistband. In other embodiments, the one or more instrument retainment features are disposed on a first section of the waistband and the draw string is disposed on a second section of the waistband. In various embodiments, the first section is disposed below the second portion.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Figure 1:
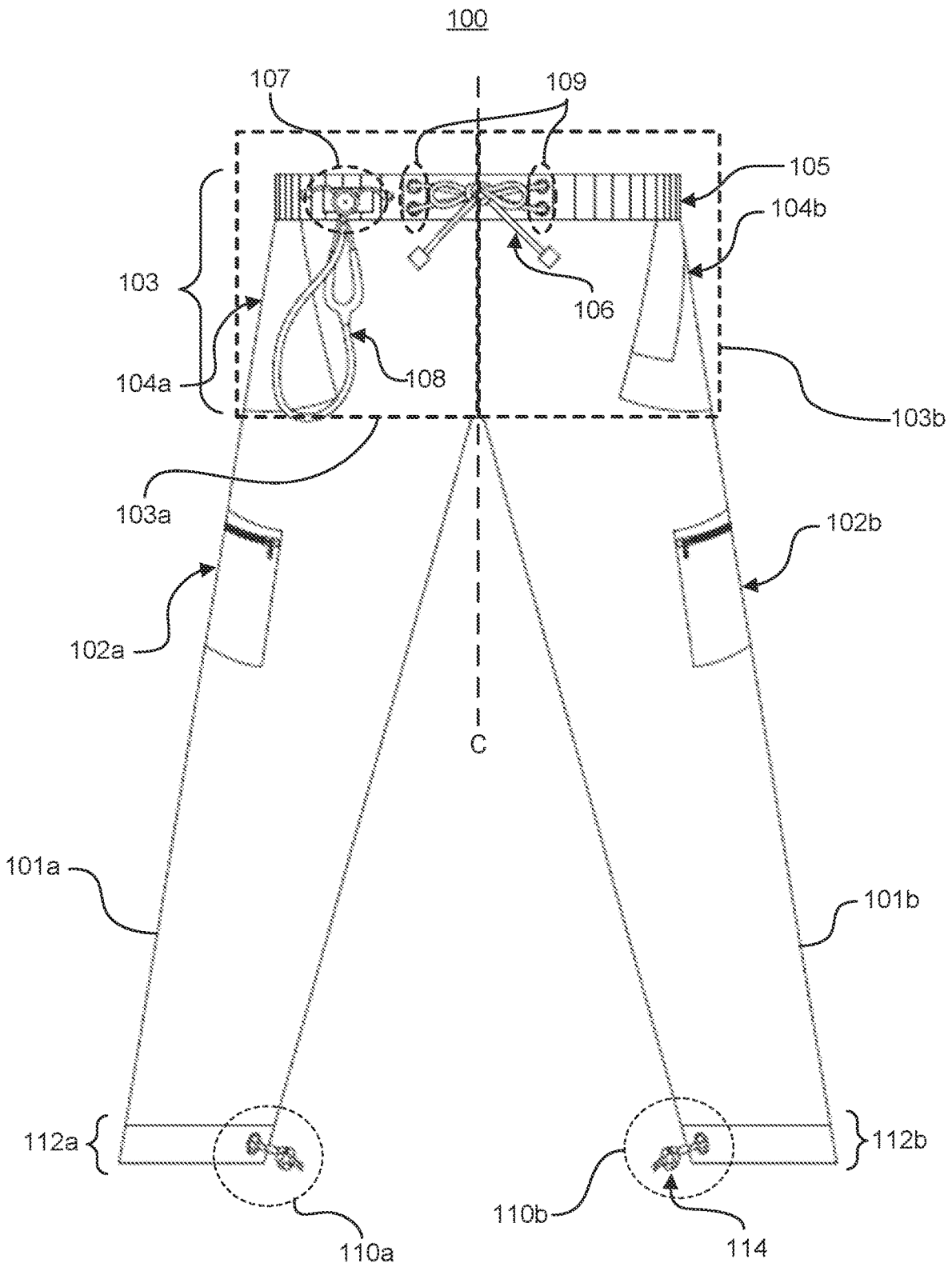
FIG. 1 is an example scrubs pants in accordance with embodiments of the technology disclosed herein.

The figures are not exhaustive and do not limit the present disclosure to the precise form disclosed.

DETAILED DESCRIPTION

Because the initial intent for scrubs were to be used in an operating environment, the conventional design does not provide many functional features that would be desirable in other environments in the hospital outside of the operating room. Unlike in the operating room, instruments and other equipment tend to be carried by individuals while performing duties within other areas, such as the intensive care unit, patient rooms, or examination rooms. However, scrubs do not have built-in features so that the person can retain these instruments in a safe and effective manner.

This lack of functionality increases the chances that tools are instruments are misplaced, lost outright, and/or contaminated during normal performance of duties. For example, in many cases individuals are required to carry instruments in one or both hands, such as stethoscopes. Because of this, when attempting to perform some action, such as adding information to a chart, the tool or instrument needs to be placed on some surface to free up the hands. This can cause the instrument to be misplaced. More importantly, this exposes the instrument to potential contamination from the surface upon which it is placed. Some instruments, like stethoscopes, can be laid across the individual's shoulders and behind the neck to free up the hands, but such methods of holding the instruments are not medically recommended for a number of reasons. The weight of the instruments can cause the shoulder muscles to tire over time sapping energy from the individual, which can lead to errors or accidents to occur. The movement of the instruments while contacting the individual's skin can also cause rashes or even cuts to form, which is an infectious disease issue (e.g., methicillin-resistant *Staphylococcus aureus* (MRSA) or other staph infections) that is unacceptable in a hospital environment. Having instruments hung around the neck also serve as a choking hazard, whether due to being caught on some obstruction or if dealing with a violent or out of control patient or individual. Finally, such a method of holding such instruments can cause damage to the instruments, either through the unintended position of the instrument or, depending on the material, deterioration of the material caused by the excess heat of contact with the skin.

Even where the scrub pants include pockets, there are many situations where the pockets are not suitable for storing the instrument or tool. Using a stethoscope as a non-limiting example, the shape and design causes the stethoscope to awkwardly rest in the pocket, increasing the chance that the stethoscope may catch on surfaces while moving. This not only poses a risk to the individual during motion but also poses a contamination risk. Such awkwardly placed instruments also are at risks of falling out of the pockets. For heavier instruments, like a stethoscope, the weight can also cause the pants to fall down from the waistline. The waistband of scrub pants must be maintained tight to the body to protect the individual from potential contaminants. Although the pants generally are secured by a draw string, elastic band, or a combination of both, the weight of some medical instruments are enough to cause waistlines that were originally secured at the proper height to sag and fall down because of the unexpected increase in the weight the draw string and/or elastic bands are trying to secure. The pockets are also not designed for such bulky instruments, resulting in the awkward positioning within the pocket to result in sagging of loose restraint of the instrument. Essentially, this loosely secured instrument functions like a limp body when being moved, flailing and moving around due to the motion that can cause the instrument to dislodge itself from the pocket.

Some clip-on or external additions to scrub pants or tops are known in the art. Clips that can be connected to the waistband of scrub pants have been used that are designed for holding specific types of instruments of tools. As an example, clip-on lanyards have been proposed that utilizes a roll of medical tape as a holster to retain a pair of shears or other small tool when attached to a scrub top or pant. Other clip-ons have been proposed specifically for stethoscopes that can clip onto the waistband of the pants, having a molded element to secure the bell and ears of the stethoscope. Although such solutions can be used to add functionality to the conventional scrubs for retaining such instruments or tools, they still are additional components that need to be added to the scrubs themselves, making them susceptible to being lost. Such additional components also fail to address the issues caused by greater weight of some instruments, still causing the pants in some instances to fall lower down from the secure position around the waist because the securing mechanism (i.e., draw string, elastic band, or both) is not designed to include such components. Moreover, these types of peripheral components are specifically designed for different instruments, requiring that the individual either wears multiple additional components (adding weight and potentially interfering with movement). Although many external solutions, such as utility belts or other externally secured means known in other industries (e.g., armed forces, firefighting, law enforcement, etc.) these other fields work in environments with different operational constraints, making the bulky and heavier approaches in these fields poorly suited for the hospital.

Embodiments of the present disclosure provide a new functional design for medical wear, such as scrub pants, to overcome many of the drawbacks to conventional scrub pants discussed above. Due to the specific requirements imposed upon scrub pants from the nature of the environment in which they are worn, many approaches to carrying tools and instruments outside of the medical field fail to address the issues in a manner that ensures the scrub pants maintain their contamination-avoidance design. As discussed in greater detail below, the scrub pants of the present disclosure includes at least one built-in containment feature designed to allow for one or more instruments or tools to be securely held against the scrub pants to minimize the chance for contamination or lose without impacting the movements of the individual. Integrating the retainment feature within the scrub pant itself reduces the need for additional weight to be added through external, peripheral securing means or clips and works in concert with the waist securing features such that the retaining of instruments using the features of the enclosed embodiments does not impact the functionality of the scrub pants themselves. In other words, the instrument retainment features, being integrated directly into the design of the scrub pants, provides a simple method of instrument retainment in a cost effective manner that can still provide the necessary features of medical scrubs.

The embodiments disclosed herein shall be discussed and explained with respect to the various embodiments depicted in the accompany figures. Although a limited number of embodiments may be depicted, other embodiments may be described only textually, with reference made to one or more of the accompanying figures to provide context or explanation. Although not depicted, the scope of this disclosure covers those text-only disclosed embodiments equally with the explicitly depicted embodiments. A person of ordinary skill, reading the instant disclosure, would be sufficiently informed as to how the text-only embodiments can be implemented.

FIG. 1 illustrates an example pair of scrub pants 100 in accordance with embodiments of the present disclosure. The example scrub pants 100 are provided for illustrative purposes only and should not be interpreted as limiting the scope of the present disclosure to only the depicted embodiment. As shown in FIG. 1, the scrub pants 100 include two pant legs 101*a*, 101*b* (collectively, "pant legs 101" or "pant leg 101"), with a thigh pocket 102*a*, 102*b* (collectively, "thigh pockets 102" or "thigh pocket 102") disposed on each of the pant legs 101*a*, 101*b*, respectively. In various embodiments, one or more thigh pockets 102 may be disposed on either or both of the pants legs 101. In some embodiments, thigh pockets 102 may be disposed only on one of the pants legs 101. Thigh pockets 102 can include a zipper or other fastening component to enable the thigh pocket 102 to be closed to secure items within.

The pant legs 101 can extend downward from a bottom side of a hip region 103. The hip region 103 is the area of the scrub pants 101 covering the hip and pelvis of the human body. The hip region 103 can have a first hip side 103*a* and a second hip side 103*b* (collectively, "hip sides 103" or "hip side 103"), each hip side 103 extending in opposite directions from the center line C. In various embodiments, one or more hip pockets 104*a*, 104*b* (collectively, "hip pockets 104" or "hip pocket 104") may be disposed within the hip region 103. As depicted in FIG. 1, hip pocket 104*a* is disposed on a first hip side 103*a* and hip pocket 104*b* is disposed on the second hip side 103*b*. In various embodiments, one or more of the hip pockets 104 may be segmented into one or more sub-pockets, with each of the sub-pockets having the same or different dimensions.

A waistband 105 is disposed on a top side of the hip region 103. As depicted in FIG. 1, the waistband 105 may include a draw string 106 securing feature. In various embodiments, the draw string 106 can be threaded within the interior of the waistband 105, with each end of the draw string 105 extending out of one or more eyelets 109 disposed on the waistband 105. The one or more eyelets 109 enable the individual to pull on the ends of the draw string 106 to cinch the waistband 105 against the individual's waist. In various embodiments, each of the one or more eyelets 109 can comprise a hole within the waistband 105 that provides access to the interior of the waistband 105. In some embodiments, the one or more eyelets 109 may be unadorned holes in the waistband 105, while in other embodiments the one or more eyelets 109 may include a reinforcement element, such as a metal, plastic, or other rigid ring secured to the portion of the waistband 105 material forming the eyelet 109.

An instrument retainment feature 107 can also be included in the waistband 105. As discussed above, conventional scrub pants comprise a simple design and do not provide features specifically designed to accommodate all types of medical instruments that are necessary while performing duties outside of the surgical space. The instrument retention feature 107 enables one or more different types of instruments 108 to be secured to the waistband 105, providing low cost and efficient retainment functionality built-in to the scrub pants 100 themselves. In the illustrated embodiment of FIG. 1, the instrument 108 is shown as a medical stethoscope, but this should not be interpreted as limiting the scope of the technology disclosed in the present disclosure. The instrument retention feature 107 can be used to retain a plurality of other medical instruments and tools, including medical shears, pagers, reflex hammers, among others.

FIGS. 2A-2F illustrate various example instrument retainment features 107 in accordance with the technology disclosed herein. Wherever common reference numerals are used across a number of different drawings, any description of the element so referenced should be interpreted to apply to every instance of the element across the various drawings, unless expressly specified otherwise. Where one or more other figures are referenced with respect to one or more elements shown in a specific figure as being "similar to," "as discussed above," "in a like manner," or other type of referential term or phrase, the disclosure associated with the element or elements there referenced apply equally to the specific figure unless otherwise stated. A plurality of example embodiments of the instrument retainment features 107 are shown in FIGS. 2A-2F, but the scope of the technology disclosed herein should not be interpreted as limited only to the depicted embodiments, and encompasses other types of instrument retainment features 107 similar to those disclosed herein.

Figure 2A:
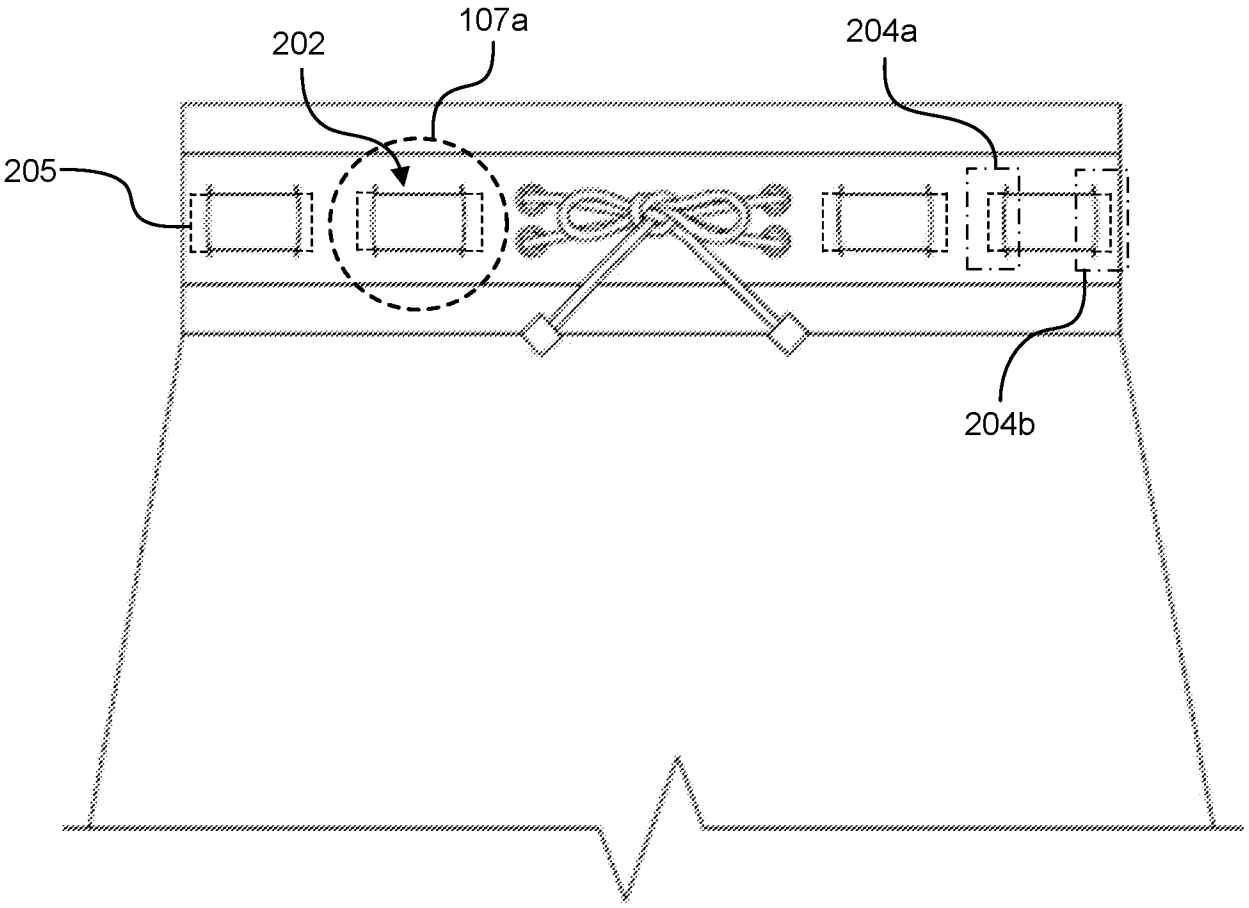
FIG. 2A is an example waistband with an example instrument retainment feature in accordance with embodiments of the technology disclosed herein.

As illustrated in FIG. 2A, the instrument retainment feature 107*a* can comprise an elastic band 202. As depicted, the elastic band 202 can include a first end 204*a* and a second end 204*b* (collectively, "ends 204" or "end 204"). In various embodiments, each of the ends 204 can be sewn into the material of the waistband 105 such that the elastic band 202 is built into the waistband 105 and extends over a portion of the circumference of the waistband 105. In various embodiments, the ends 204 may be built into the waistband 105 in various ways, including but not limited to, sewing, glued, heat-welded, stapled, pinned, riveted, or otherwise secured to the material. As illustrated in FIG. 2A, the ends 204 are shown as being secured on the interior of the waistband 105 as represented by the broken lines 205. That is, the elastic band 202 is woven into the waistband 105 in one or more locations, with the first end 204*a* is within an interior of the waistband and exits the waistband at an opening so that the elastic band 202 extends over the exterior surface of the waistband 105, and the second end reenters the interior of the waistband 105 through a second opening. As arranged, the elastic band 202 comprises a middle portion exposed to a user and positioned parallel to the exterior surface of the waistband 105, the middle portion defined as the portion of the elastic band 202 between the first end 204*a* and the second end 204*b*. In various embodiments, the middle portion could be defined as the portion of the elastic band 202 defined as the portion between the first opening closest to the first end 204*a* and the second opening closest to the second end 204*b*. In some embodiments, the ends 204 may be secured to the exterior surface of the waistband 105. When in a non-stressed position, the elastic band 202 can be configured to rest flat against the waistband 105. In various embodiments, the elastic band 202 can be attached to the waistband 105 such that the ends 204 of the elastic band 202 are secured on the exterior surface of the waistband 105. In other embodiments, the ends 204 may be inserted into an interior void of the waistband 105 through one or more openings (not shown in FIG. 2A) and secured on the interior surface of the waistband 105. The elastic band 202 can include one or more types of materials having an elastic quality commonly used in the fashion industry. In various embodiments, the first end 204*a* and the second end 204*b* may be positioned such that the elastic band 202 extends all or substantially all of the entire circumference of the waistband 105, forming a circular elastic band 202. That is, the elastic band 202 can extend from the first end 204*a*, around the rear of the waistband 105, to the second end 204*b*.

Although the term "flat" is used to refer to the non-stressed position of the elastic band 202, a person of ordinary skill in the art would understand that, when worn by an individual, the waistband 105 and, therefore, the elastic band 202 would deform according to the shape of the individual's body, and would understand that the descriptor "flat" is considered from the relationship of the elastic band 202 to the waistband 105 without considering and curvature or other differences in shape caused by the body. Moreover, a person of ordinary skill in the art would understand that "flat" as used herein does not require that the waistband material 105 be smoothed out and free of all ridges, folds, or other orientations of the material of the waistband 105.

When an instrument needs to be carried, the user can grab the elastic band 202 and stretch the elastic band 202 into a stressed position such that a void is created between the elastic band 202 and the waistband 105, into which the instrument may be inserted. Once inserted, the elastic band 202 can be relaxed and returned back to the non-stressed position, thereby securing retaining the instrument (e.g., a stethoscope, shears, etc.) against the waistband 105. In this way instruments and/or tools needed by the individual can be securely retained without the need for peripheral components, eliminating cost. Moreover, because the elastic band 202 is built into the waistband 105, the weight of the instrument has less impact on the proper placement of the waistband 105 once secured using the draw string 106. When using external peripheral components, like clip-on solutions, the integrity of the closure of the waistband 105 against the individual's body is compromised, creating space such that the external component can be attached, which can necessitate either that the draw string 106 is readjusted. This can be inconvenient to the user as well as exposing the user to potential discomfort from having another object be tightly pushed against the person's body (because of the need to ensure the waistband 105 is tight against the body to keep the waistband 105 in place). The elastic band 202 does not comprise the integrity of the contact between the waistband 105 and the person's body, thereby reducing the chance that the waistband 105 may fall or sag.

Figure 2B:
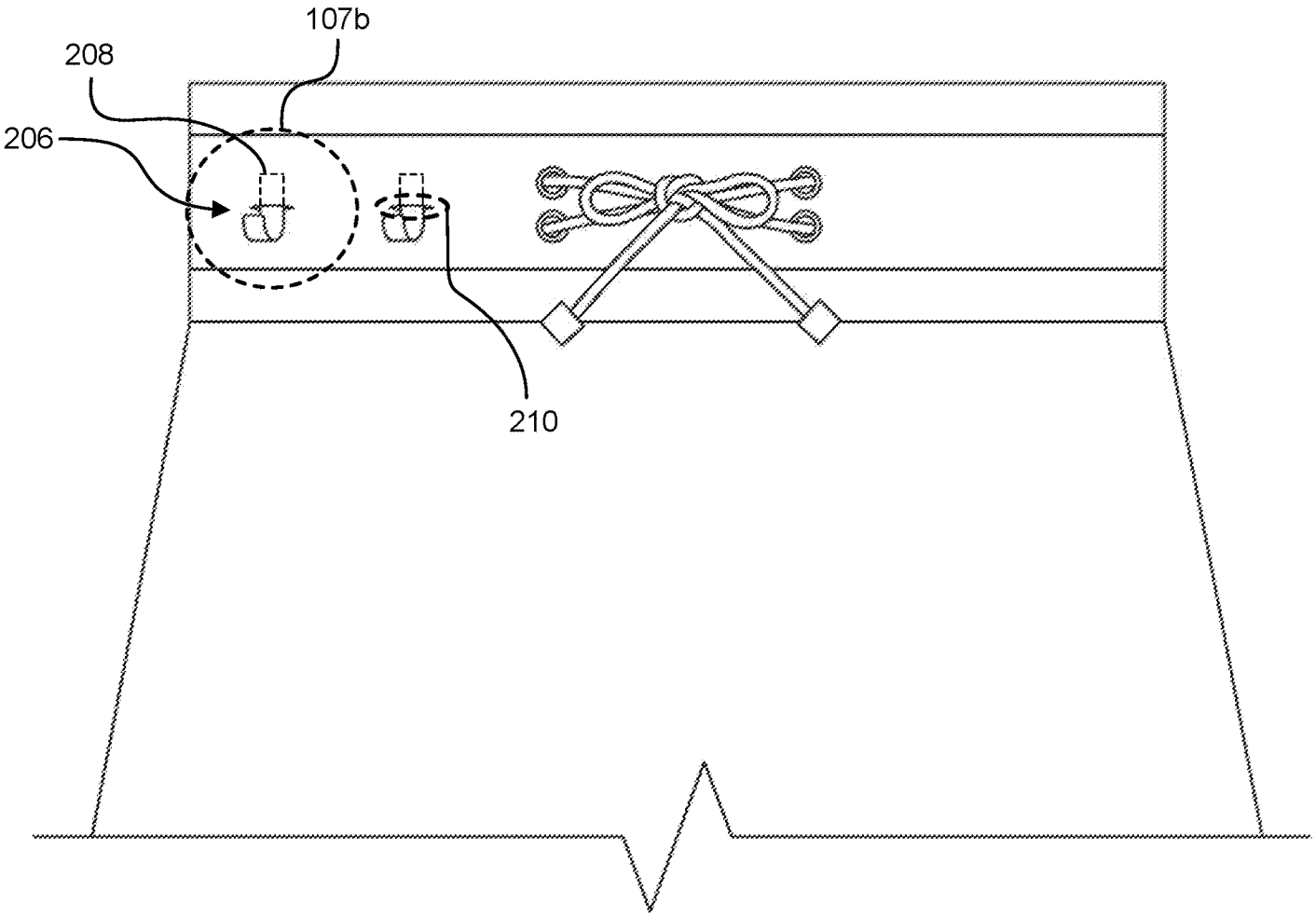
FIG. 2B is another example waistband with another example instrument retainment feature in accordance with embodiments of the technology disclosed herein.

In various embodiments, the instrument retainment feature 107 can comprise one or more hooks 206, as depicted by the example embodiment 107*b* illustrated in FIG. 2B. The example hooks 206 can provide a connection point for one or more instruments or tools having a compatible securing structure disposed thereon. Non-limiting examples of a compatible securing structure includes handles, eyelets, indentions or protrusions creating a void within which one or more hooks 206 can interface, among other structures. In various embodiments, the securing structure disposed on the instrument or tool can be designed to interface with the hooks 206, while in other embodiments the securing structure can comprise a structure that is part of the instrument or tool but was not designed specifically to interface with the hooks 206. The hooks 206 can be built into the waistband 105 in a similar manner and using similar means as discussed above with respect to the elastic band 202. In some embodiments, a rear portion 208 of one or more hooks 206 can be secured to the waistband 105 within an interior of the waistband 105, as shown by the broken line, the rear portion 208 entering the waistband 105 through an opening 210 in the waistband 105 (as shown by the broken lines in FIG. 2B). In some embodiments, the hooks 206 may be secured to the exterior surface of the waistband 105. In some embodiments, the waistband 105 can include one or more hook attachment features (not shown in FIG. 2B) designed to allow the user to attach a hook 206 to the waistband 105. In such embodiments, the hook attachment feature is built into the waistband 105, with the hooks 206 being attachable and detachable from the waistband 105. The hooks 206 can comprise one or more materials, including but not limited to plastic, metal, ceramic, or a combination thereof. In some embodiments, the hooks 206 can be rigid, maintaining a single shape, while in other embodiments the hooks 206 can comprise a flexible material configured to allow the hook 206 to be moved into one or more shapes and maintain the shape in which it is moved.

Figure 2C:
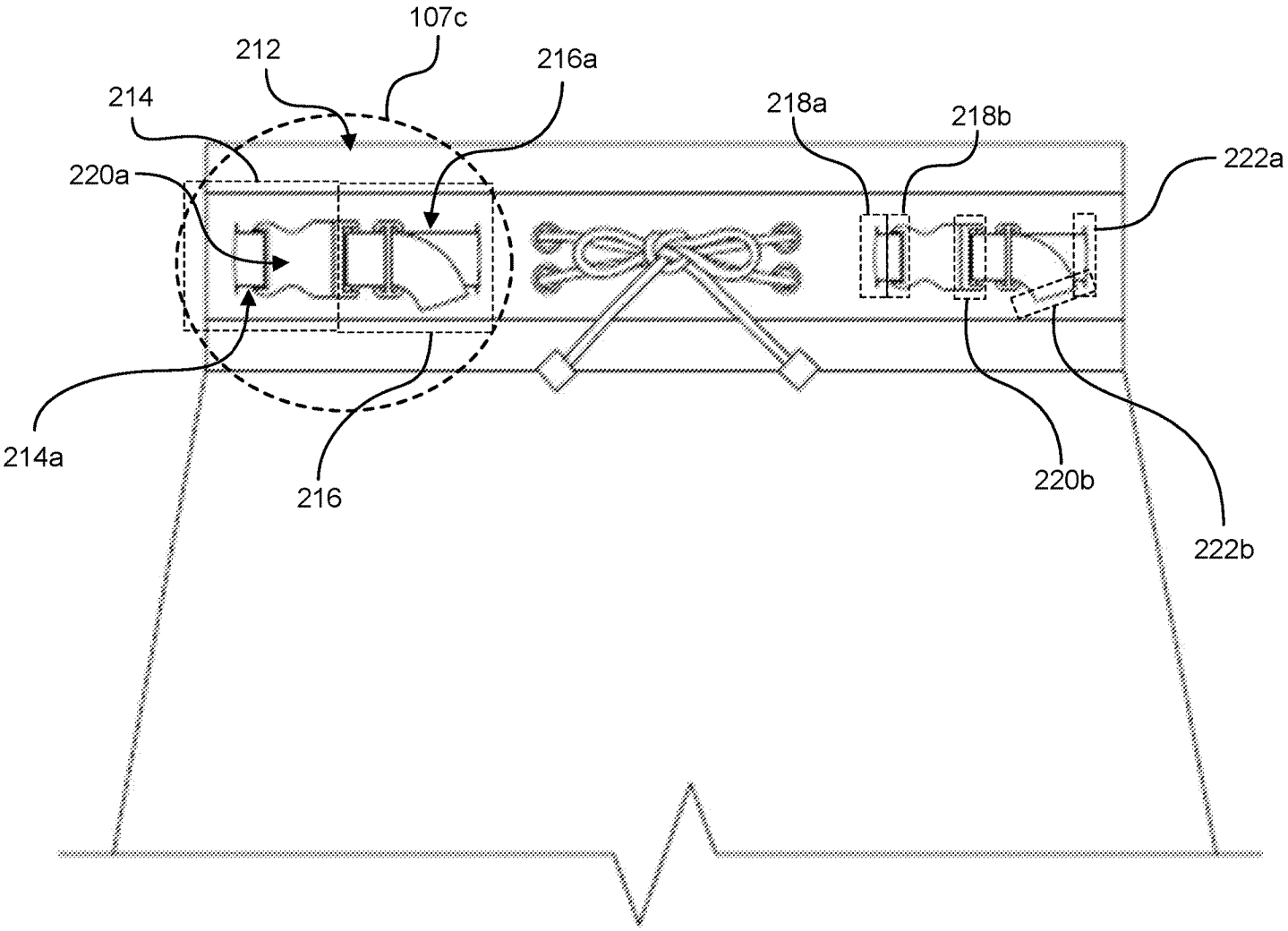
FIG. 2C is another example waistband with another example instrument retainment feature in accordance with embodiments of the technology disclosed herein.

In some other embodiments, the instrument retainment feature 107 can comprise a buckle 212, such as the example instrument retainment feature 107*c* depicted in FIG. 2C. For ease of discussion, the buckle 212 depicted in FIG. 2C is depicted as a side release buckle, but that should not be interpreted to limit the buckle 212 to only this type of buckle. In various embodiments, the buckle 212 can comprise any type of buckle or clasp. As shown in FIG. 2C, the buckle 212 comprises a first portion 214 and a second portion 216. In various embodiments, the first portion 214 can comprise a strap 214*a* having a first end 218*a* and a second end 218*b*. In various embodiments, a catch component 220*a* may be disposed on the second end 218*b* of the strap 214*a*. The catch component 220*a* is one side of the securing component forming the buckle 212, the catch component 220*a* comprising the fastener portion (e.g., hook, pin, seat belt tongue, etc.) that is inserted into or other otherwise coupled to the receiver component 222. FIG. 2C illustrates the catch component 220*a* (i.e., the side release buckle tongue) coupled to the receiver component 220*b* by inserted the catch component 220*a* into an interior space of the receiver component 220*b* through an opening of the receiver component 220*b*. The second portion 216 can comprise a strap 216*a* having a first end 222*a* and a second end 222*b*. In various embodiments, the receiver component 220*b* may be moveably coupled to the strap 216*a*, with the second end 222*b* of the strap 216*a* inserted within a slot disposed on a rear of the receiver component 220*b* such that the second end 222*b* of the strap 216*a* is wrapped around the slot and can extend towards the first end 222*a*. The receiver component 220*b* is moveable along the length of the strap 216*a* defined by the first end 222*a* and the second end 222*b*.

Although the first portion 214 is disclosed as having the catch component 220*a* disposed thereon, and the second portion 216 is disclosed as having the receiver component 220*b*, this is provided for example purposes only. In various embodiments, the receiver component 220*b* may be disposed on the first portion 214 and the catch component 220*a* may be disposed on the second portion 216. When an instrument or tool needs to be secured, the instrument or tool can be placed against the waistband 105 and the catch component 220*a* is inserted into the receiver component 220*b*. To retain the instrument or tool, the second end 222*b* of the strap 216*a* can be pulled such that more of the strap 216*a* is pulled through the slot to move the receiver component 220*b* in a direction towards the first end 222*a* of the strap 216, tightening the buckle 212 against the instrument or tool, in turn tightening the instrument or tool against the waistband 105 to secure the instrument or tool against the person.

Figure 2D:
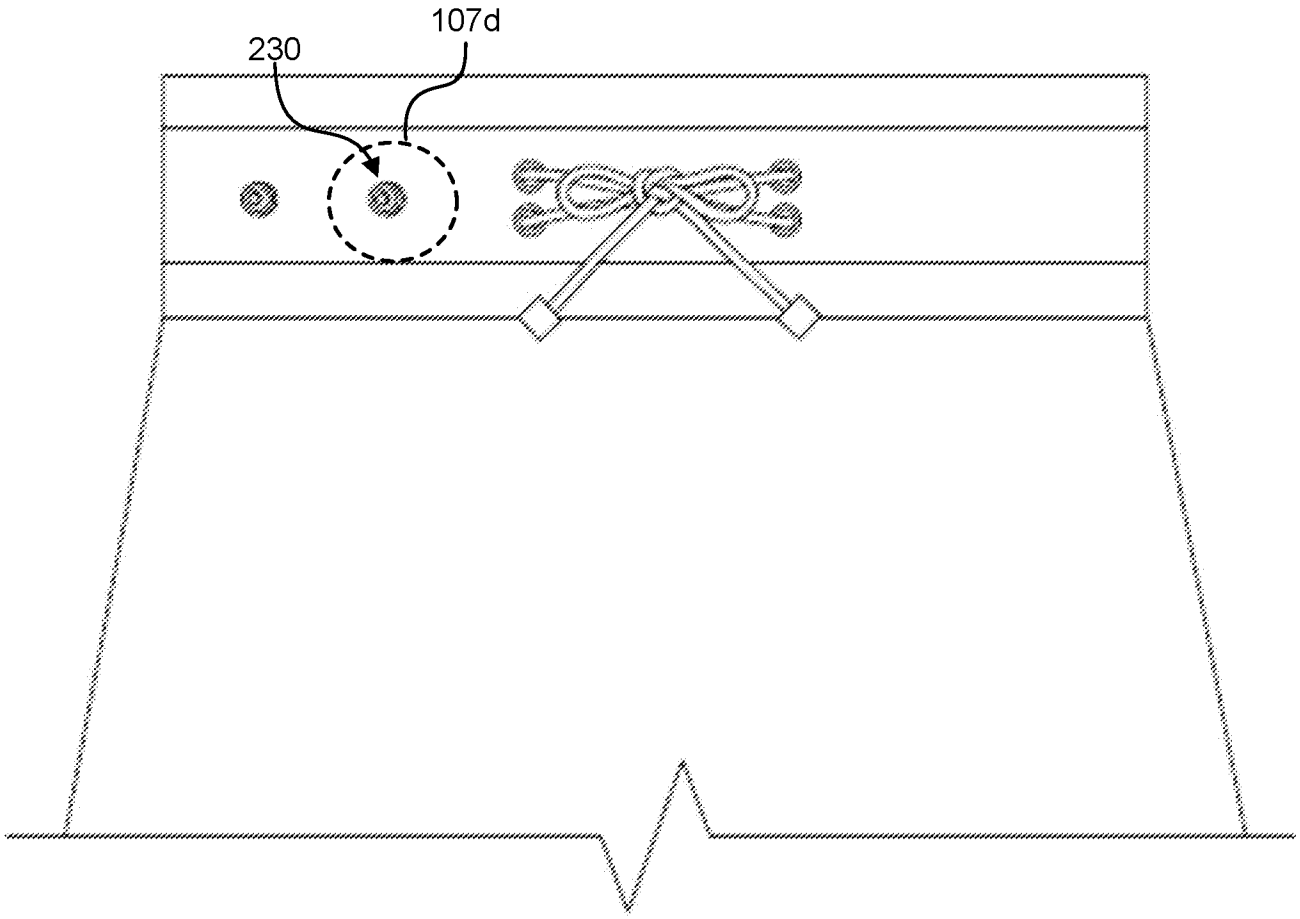
FIG. 2D is another example waistband with another example instrument retainment feature in accordance with embodiments of the technology disclosed herein.

FIG. 2D illustrates another example instrument retainment feature 107*d* in accordance with embodiments of the technology of the present disclosure. As depicted, the instrument retainment feature 107*d* comprises one or more snap fasteners 230. The snap fasteners 230 can be configured to couple with a corresponding disc disposed on the instrument or tool. The snap fasteners 230 can be built into the waistband 105 in a similar manner as discussed above with respect to the elastic band 202 of FIG. 2A.

Figure 2F:
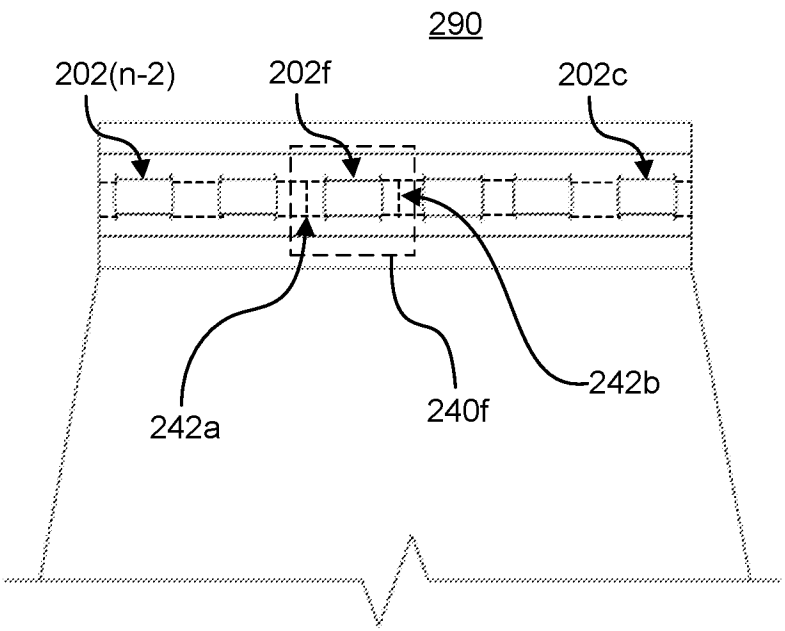
FIG. 2F is a back side of another example waistband with another example instrument retainment feature in accordance with embodiments of the technology disclosed herein.
Figure 2E:
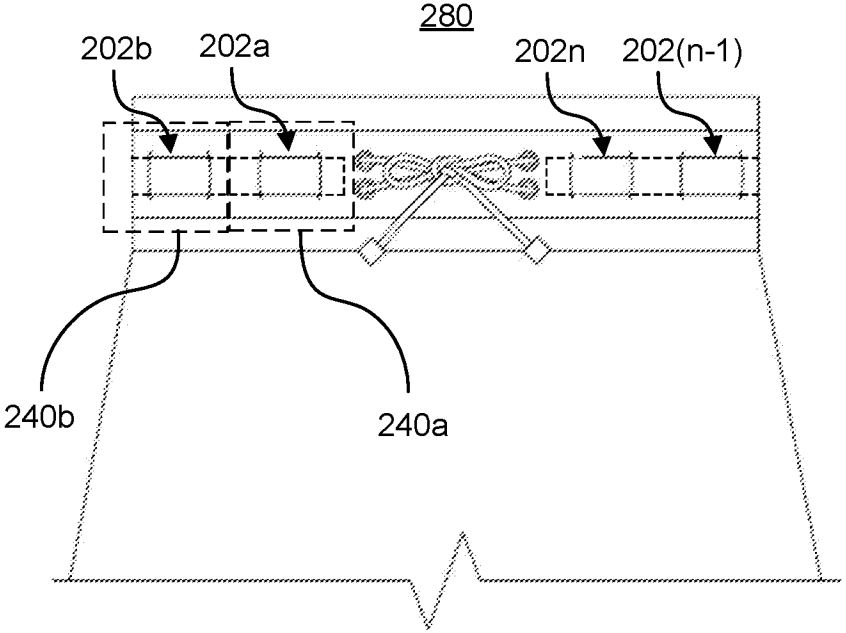
FIG. 2E is a front side of another example waistband with another example instrument retainment feature in accordance with embodiments of the technology disclosed herein.
Figure 2G:
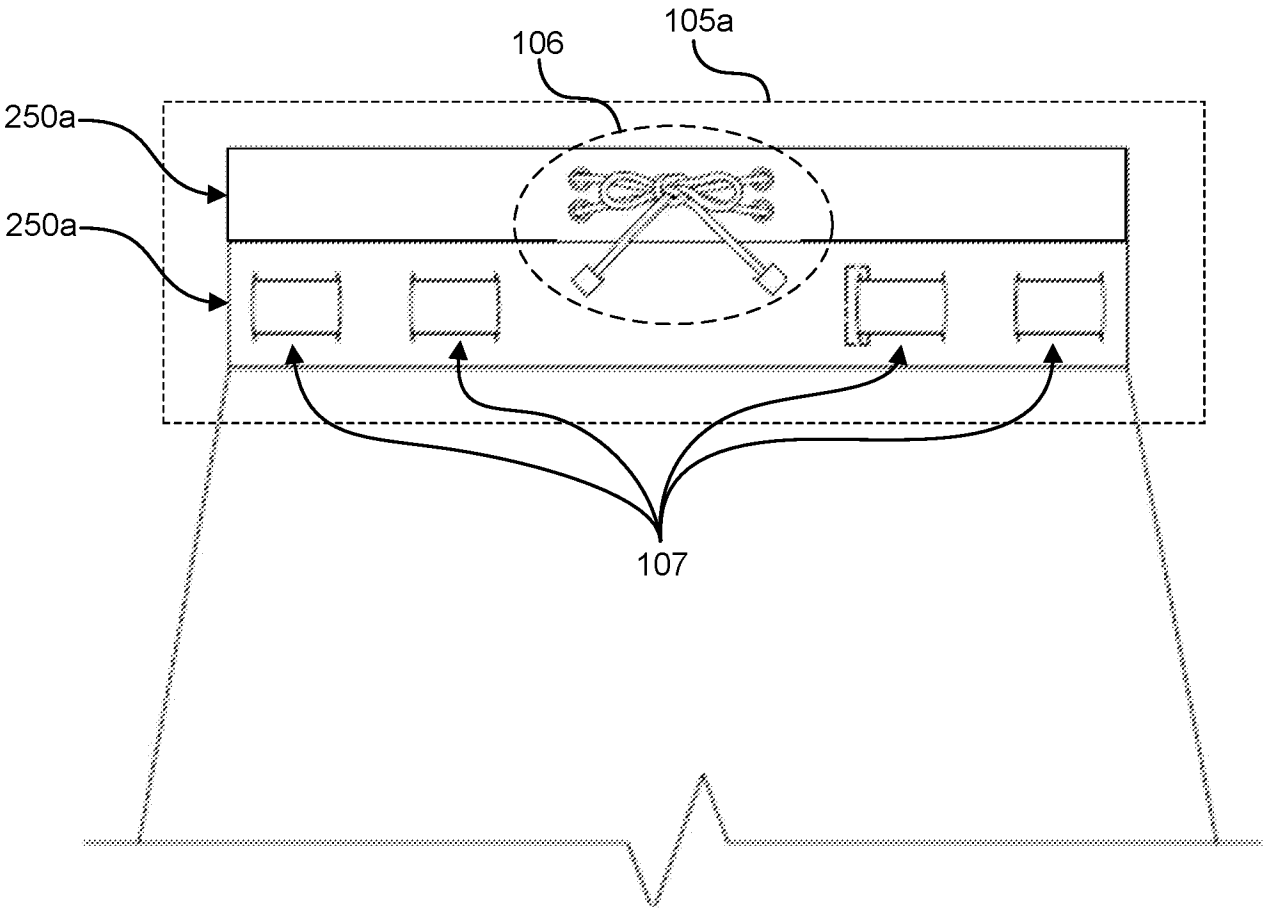
FIG. 2G is another example waistband with another example instrument retainment feature in accordance with embodiments of the technology disclosed herein.

In various embodiments, more than one instrument retainment feature 107 can be disposed along the circumference of the waistband 105. FIGS. 2E and 2F illustrates an example embodiment wherein multiple instrument retainment features 107 are disposed along the circumference of the waistband 105 in accordance with the technology disclosed herein. FIG. 2E illustrates a front side 280 of the scrub pants and FIG. 2F illustrates a back side 290 of the scrub pants. As depicted in FIGS. 2E and 2F, there are several regions 240, each having an instrument retainment feature 107 disposed therein. In the illustrated embodiment, each of the regions 240 include an elastic band-type instrument retainment feature, similar to the elastic band 202 discussed with respect to FIG. 2A above. In some embodiments, each elastic band 202*a*-202*n* can be a separate elastic band component (as shown in FIG. 2A), while in other embodiments each elastic band 202*a*-202*n* may be different portions of the same elastic band 202 extending around all or substantial all of the circumference of the waistband 105 (as shown in FIGS. 2E and 2F), wherein each region 240 represents an opening in the waistband 105 that enables the person to interface with the portion of the elastic band 202 within the region 240 to move the portion 202*a*-202*n* to either a stressed or destressed position (as discussed above with respect to FIG. 2A). In some embodiments, each region 240 may include one or more attachment points, such as attachment points 242*a* and 242*b* of region 240*f*. In such embodiments, the attachment points 242*a* and 242*b* serve to secure the portion of the elastic band 202*f* within the region 240*f*, thereby ensuring that interacting with any of the other portions 202*a*-202*n* does not interfere with the portion 202*f*. In such embodiments, the first end 244*a* of the elastic band portion 202*f* is attached to the first attachment point 242*a* and the second end of the elastic band portion 202*f* is attached to the second attachment point 242*b*. Accordingly, if an instrument or tool is retained within the portion 202*f*, movement or use of another portion (e.g., portion 202*c* in region 240*c*) does not cause any movement or change in the positioning of the portion 202*f*. In some embodiments, adjacent regions 240 may share the same attachment point 242 such that an end of the elastic band portions in the adjacent regions 240 are secured at the same attachment point 242. In various embodiments, the elastic band-type retainment feature may go around substantially all of the circumference of the waistband 105. In the present disclosure, "substantially all" comprises an elastic band-type instrument retainment feature extending from a first end secured next to a first eyelet of the drawstring 106 to a second end secured next to a second eyelet of the drawstring 106.

Although FIG. 2E discusses multiple regions 240 with respect to elastic band-type instrument retainment features 107, such discussion is applicable to other embodiments, such as the embodiments discussed with respect to FIGS. 2B-2D. Moreover, although discussed as separate embodiments, one or more types of instrument retainment features 107 can be combined in various embodiments. In various embodiments, at least one region 240 can include a different instrument retainment feature from one or more regions. In various embodiments, the type of instrument retainment feature discussed with respect to FIGS. 2E and 2F can be the drawstring 106 itself. In such embodiments, the drawstring 106 can weave in and out of the waistband 105 through one or more openings (similar to the openings discussed with respect to the elastic band 202, the hooks 206, and the buckle 212 discussed above with respect to FIGS. 2A-2C) within the regions 240 in a similar manner as the elastic band portions discussed with respect to FIGS. 2E and 2F. Utilizing the drawstring 106 as both the means for maintaining the level of the waistband 105 on the person's body and as the retaining means for an instrument or tool (e.g., a stethoscope). The instrument or tool can be secured in a similar manner as that discussed above with respect to the elastic band 202 of FIG. 2A, where the drawstring portion exposed within a region 240 (i.e., exits the waistband 105 through a first opening and reenters the waistband 105 through a second opening) can be extended into a stressed position by the person to create a space between the drawstring portion and the waistband 105 surface and the instrument or tool can be entered into the space. When the drawstring portion within the region 240 is returned to a non-stressed position, the drawstring portion in the region exerts a force against the instrument or tool to retain the instrument or tool against the person's body, while also serving to maintain the level of the waistband 105.

Referring to FIG. 1, the instrument retainment features 107 discussed above may be disposed in the same plane as the draw string 106, as shown in FIGS. 1-2F. In various embodiments, the instrument retainment features 107 and the draw string 106 may be disposed within the same interior of the waistband 105, while in other embodiments the waistband 105 may have a first interior associated with the instrument retainment features 107 and a second interior associated with the draw string 106 so that the instrument retainment features 107 and the draw string 106 are separated by a middle wall of the waistband 105. In some embodiments, the instrument retainment features 107 may be positioned above or below the draw string 106. In such embodiments, the waistband 105*a* can comprise two sections 250*a* and 250*b* (collectively, "sections 250" or "section 250") as depicted in the example waistband 105*a* of FIG. 2G. As shown, each section 250 can be associated with one of the instrument retainment features 107 or the draw string 106. In some embodiments, section 250*a* can be associated with the draw string 106 (i.e., the draw string 106 is disposed within the section 250*a*) and section 250*b* can be associated with the instrument retainment features 107. In other embodiments, the association of the sections 250 may be reversed. Separating the waistband 105 into two sections enables the instrument retainment features 107 to be positioned along the person's waist in a more effective manner. As a non-limiting example, a stethoscope might be more comfortably secured if the instrument retainment feature 107 is positioned lower than the draw string 106 used to secure the scrub pants to the person's waist.

Figure 3:
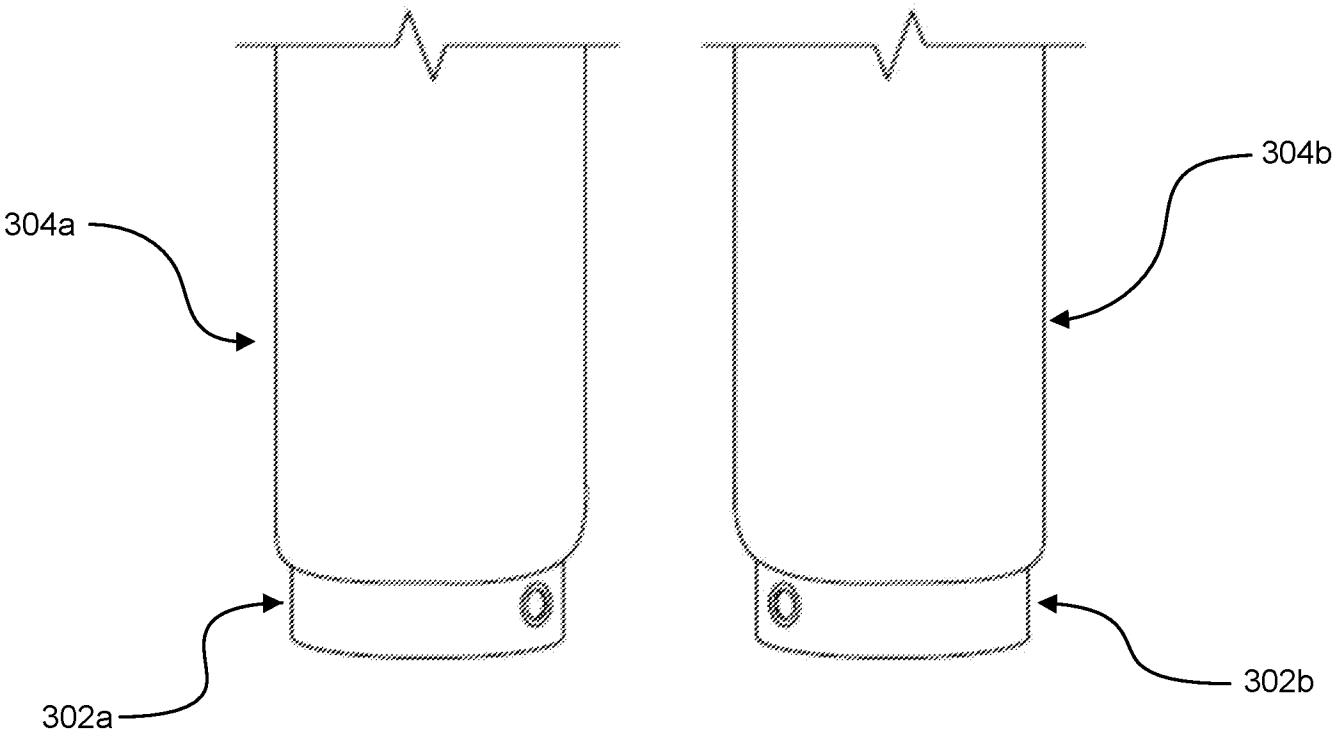
FIG. 3 is an example leg ends in a cinched position in accordance with embodiments of the technology disclosed herein.

Referring to FIG. 1, the scrub pants 100 can include a pant leg adjuster 110*a* and 110*b* (collectively, "pant leg adjusters 110") disposed on a leg end 112*a* and 112*b* (collectively, "leg ends 112"), respectively. The pant leg adjusters 100 enable the person to adjust the form and function of the bottom of each pant leg (i.e., the leg ends 112), allowing the leg ends 112 to be in a relaxed position (i.e., non-adjusted), a cinched position, or any intermediate position between the relaxed position (as depicted in FIG. 1) and the cinched position (as depicted in FIG. 3). The example leg ends 302*a* and 302*b* illustrate the cinched position, whereby the leg ends 302*a* and 302*b* are reduced in circumference relative to the circumference of the remainder of leg portion 304*a* and 304*b*. In various embodiments, the pant leg adjusters 110 can comprise a leg drawstring 114. The leg drawstring 114 can have a toggle disposed on the end, the ends of the leg drawstring 114 being routed through an opening in the toggle and the toggle. In the rest state, the toggle is kept in place by a stopper inside the opening of the toggle exerting a force against the ends of the leg drawstring 114 to push the ends of the leg drawstring 114 against an interior surface of the opening. To adjust the position of the leg ends 112 a button on the toggle can be depressed, thereby releasing the pressure exerted by the stopper and allowing the toggle to move along the length of the ends of the leg drawstring 114.

Figure 4:
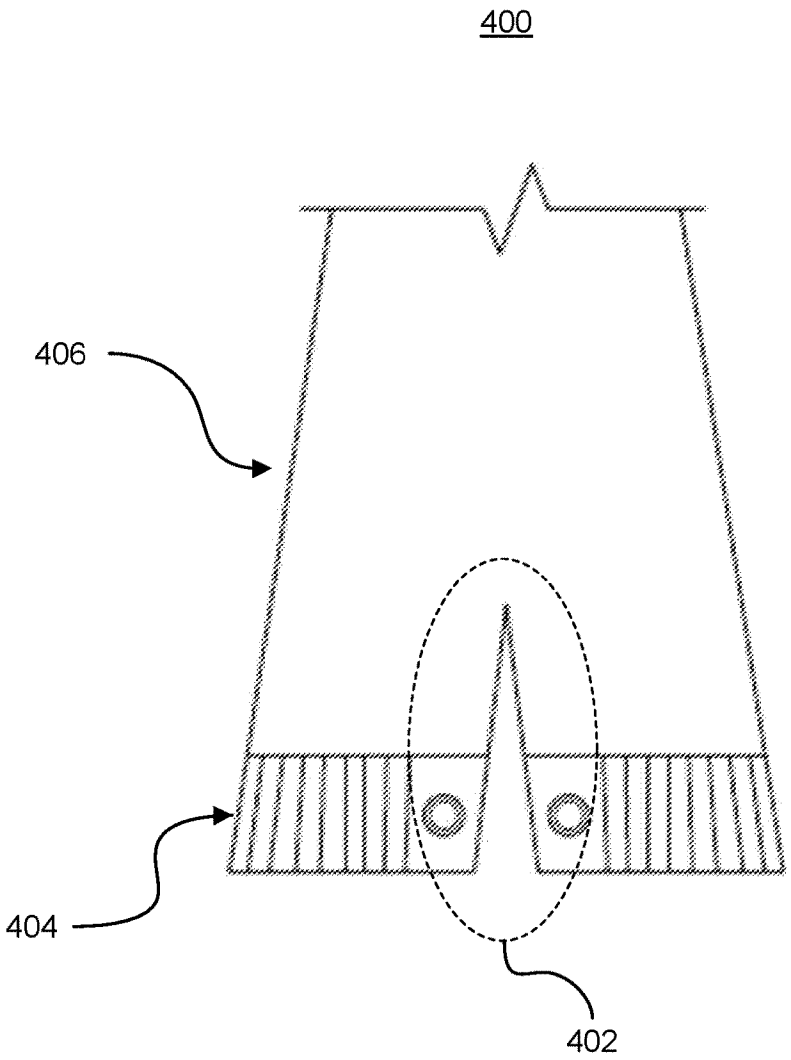
FIG. 4 is an example scrub pants leg with an adjustment slit in accordance with embodiments of the technology disclosed herein.

As seen in FIG. 3, when in the cinched position the material in the leg portion 304*a* and 304*b* can billow over or bunch up above the leg ends 302*a* and 302*b*. In some embodiments, an adjustment slit can be included in the leg ends. FIG. 4 illustrates example leg 400 in accordance with the technology of the present disclosure. As shown in FIG. 4, the leg 400 can include an adjustment slit 402 extending through the leg end 404 and into the leg portion 406. The adjustment slit 402 reduces the amount of material of the leg portion 406 that needs to be compressed when the leg end 404 is moved from the rest state to the cinched state. In various embodiments, the adjustment slit 402 may have a backing swatch (not shown in FIG. 4) disposed on the inside of the leg portion 406 and/or the leg end 404 and extending across the width of the adjustment slit 402 to cover the person's leg when the leg end 404 is in the rest state. In various embodiments, the backing swatch can comprise a different material from the material comprising the leg material. In other embodiments, the slit 402 may not have a backing swatch, and when in the rest position the person's leg is exposed to the air.

Figure 5:
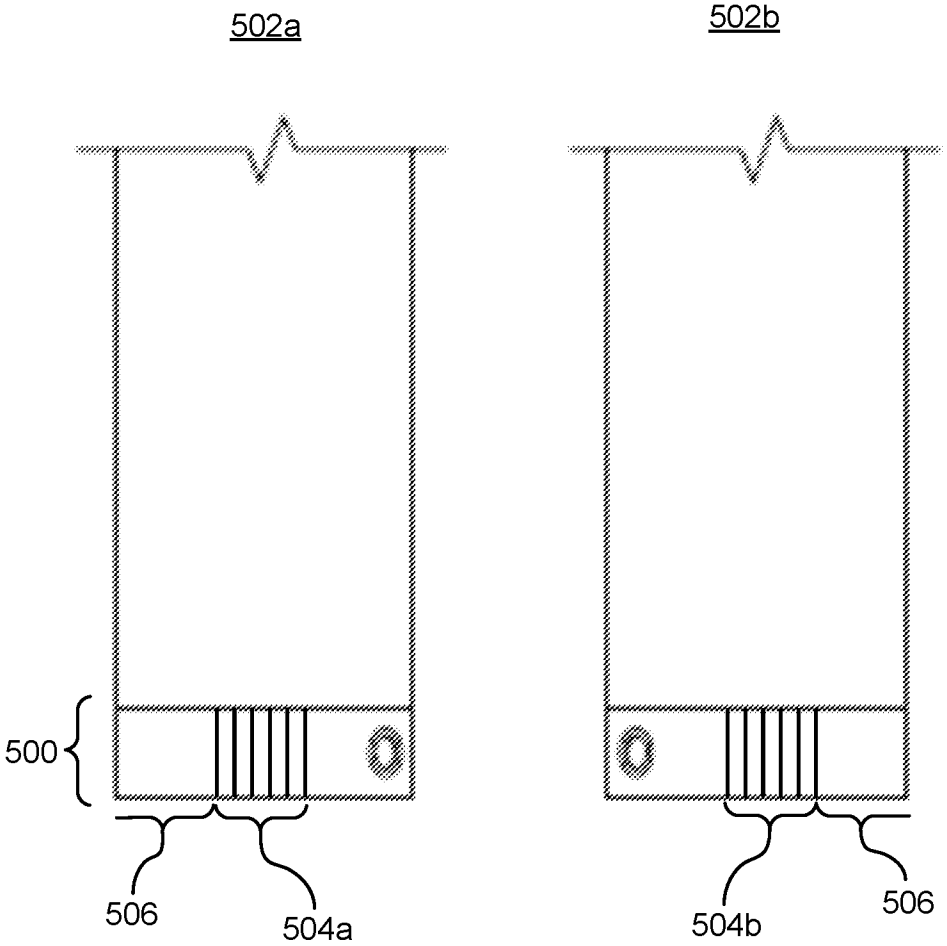
FIG. 5 is an example of a leg end with multiple elastic sections in accordance with embodiments of the technology disclosed herein.

The leg end 404 depicted in FIG. 4 comprises elastic material (represented by the vertical lines). In various embodiments, the entire leg end 404 may comprise an elastic material. In other embodiments, one or more portions of the leg end 404 may comprise elastic material. FIG. 5 illustrates an example leg end 500 comprise a first side 502*a* and a second side 502*b* in accordance with embodiments of the technology disclosed herein. As shown in FIG. 5, the leg end 500 comprises a non-elastic section 506 having a first elastic section 504*a* connected to a first end and a second elastic section 504*b* connected on a second end. By having the elastic material 504 only used in certain sections of the leg end 500 the bunching effect when the leg end 500 is cinched is further reduced because such bunching is less to occur in the non-elastic sections. In some embodiments, the leg end 500 may further include a slit similar to the slit 402 discussed with respect to FIG. 4 above.

As used herein, the term "or" may be construed in either an inclusive or exclusive sense. Moreover, the description of resources, operations, or structures in the singular shall not be read to exclude the plural. Conditional language, such as, among others, "can," "could," "might," or "may," unless specifically stated otherwise, or otherwise understood within the context as used, is generally intended to convey that certain embodiments include, while other embodiments do not include, certain features, elements and/or steps.

Terms and phrases used in this document, and variations thereof, unless otherwise expressly stated, should be construed as open ended as opposed to limiting. Adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that may be available or known now or at any time in the future. The presence of broadening words and phrases such as "one or more," "at least," "but not limited to" or other like phrases in some instances shall not be read to mean that the narrower case is intended or required in instances where such broadening phrases may be absent.

What is claimed is:

1. A scrub pants comprising:

two pant legs extending downward from a bottom side of a hip region;

a waistband disposed on a top side of the hip region;

a drawstring disposed in the waistband to adjust a circumference of the waistband; and an instrument retainment feature disposed on the waistband, the instrument retainment feature including an elastic band having a first end, a middle, and a second end, and a boundary of the middle being defined at least in part by a first circumferential edge and a second circumferential edge disposed opposite the first circumferential edge, wherein each of the first end and the second end of the elastic band are fixedly attached to the waistband via at least one of sewing, gluing, stapling, riveting, or heat sealing, wherein the first circumferential edge and the second circumferential edge of the elastic band each extend in a direction along a circumference of the waistband from the first end on the waistband to the second end on the waistband such that at least a portion of the first circumferential edge and at least a portion of the second circumferential edge of the elastic band, between the first end and the second end, are unattached from the waistband and the scrub pants, wherein the elastic band extends elastically externally away from the scrub pants, whereby a void is defined between:

an inner-facing surface of the elastic band and an outer-facing surface of the waistband, and the first end and the second end, and wherein the void extends unobstructed beyond both the first circumferential edge and the second circumferential edge of the elastic band such that when an instrument is retained by the instrument retainment feature, a portion of the instrument rests against an outer surface of a pant leg of the two pant legs.

2. The scrub pants of claim 1, wherein the elastic band of the instrument retainment feature is a first elastic band of a first instrument retainment feature, and wherein the scrub pants further comprise a second instrument retainment feature including a second elastic band that extends in the direction of the circumference of the waistband from a third end on the waistband to a fourth end on the waistband such that at least a portion of a middle of the second elastic band between the third end and the fourth end is unattached from the waistband and extends externally away from the scrub pants.

3. The scrub pants of claim 2, wherein the first elastic is separate from the second elastic band.

4. The scrub pants of claim 1, wherein the drawstring extends around the waistband in a passage, and wherein the first end and the second end of the elastic are attached to an interior surface of the passage in the waistband without interfering with the drawstring.

5. The scrub pants of claim 1, wherein the elastic band is attached to an exterior surface of the waistband at a first position and a second position.

6. A lower-body garment comprising:

a waistband;

leg portions extending from the waistband;

a drawstring disposed in the waistband to provide adjustability of a size of the waistband; and an elastic band having a first end, a middle, and a second end, and a boundary of the middle being defined at least in part by a first circumferential edge and a second circumferential edge disposed opposite the first circumferential edge, wherein each of the first end and the second end of the elastic band are fixedly attached to the waistband via at least one of sewing, gluing, stapling, riveting, or heat sealing, wherein the first circumferential edge and the second circumferential edge of the elastic band each extend in a direction along a circumference of the waistband from the first end on the waistband to the second end on the waistband such that at least a portion of the first circumferential edge and at least a portion of the second circumferential edge of the elastic band, between the first end and the second end, are unattached from the waistband and the lower-body garment, wherein the elastic band extends elastically externally away from the lower-body garment, a void is defined between:

an inner-facing surface of the elastic band and an outer-facing surface of the waistband, and the first end and the second end, and wherein the void extends unobstructed beyond both the first circumferential edge and the second circumferential edge of the elastic band such that when an instrument is retained by the elastic band, a portion of the instrument rests against an outer surface of a leg portion of the leg portions.

7. The lower-body garment according to claim 6, wherein the elastic band is sewn to the waistband.

8. The lower-body garment according to claim 6, wherein the elastic band is disposed at a front side of the waistband that is offset from a center-body region of the waistband.

9. The lower-body garment according to claim 6, wherein the drawstring extends outward from a front side of the waistband at a center-body region of the waistband, the drawstring extending from inside the waistband via eyelets.

10. The lower-body garment according to claim 6, wherein the elastic band includes two elastic bands, each elastic band being respectively positioned opposite each other, offset from a center-body region of the waistband.

11. The lower-body garment according to claim 6, wherein the leg portions include pockets.

12. The lower-body garment according to claim 6, wherein the portion of the elastic band between the first end and the second end is sized to accommodate a folded stethoscope therethrough.

13. The lower-body garment according to claim 6, wherein the void has a width to accommodate a folded stethoscope therethrough.

* * * * *